US008056712B2

(12) United States Patent
Igawa et al.

(10) Patent No.: US 8,056,712 B2
(45) Date of Patent: Nov. 15, 2011

(54) JOB BAG FOR LENSES AND ASSOCIATED DOCUMENT

(75) Inventors: Allison Igawa, Cypress, CA (US); Timothy George Stephan, Huntington Beach, CA (US); Phillip Velasquez, Pico Rivera, CA (US); Arman Bernardi, Glendale, CA (US)

(73) Assignee: I-Coat Company, LLC, Sante Fe Springs, CA (US)

( * ) Notice: Subject to any disclaimer, the term of this patent is extended or adjusted under 35 U.S.C. 154(b) by 0 days.

(21) Appl. No.: 12/768,537

(22) Filed: Apr. 27, 2010

(65) Prior Publication Data

US 2010/0276314 A1 Nov. 4, 2010

Related U.S. Application Data

(60) Provisional application No. 61/173,143, filed on Apr. 27, 2009.

(51) Int. Cl.
*B65D 85/38* (2006.01)

(52) U.S. Cl. ..... 206/316.1; 206/232; 206/425

(58) Field of Classification Search ..... 206/5.1, 206/232, 316.1, 316.2, 425, 459.5; 229/72; 383/38–40

See application file for complete search history.

(56) References Cited

U.S. PATENT DOCUMENTS

| | | | | |
|---|---|---|---|---|
| 2,827,096 | A * | 3/1958 | Hinson | 206/316.2 |
| 3,435,868 | A * | 4/1969 | Stermer | 383/39 |
| 4,620,579 | A * | 11/1986 | Lowe et al. | 206/316.2 |
| 4,852,783 | A * | 8/1989 | Bryden et al. | 150/149 |
| 5,062,530 | A * | 11/1991 | Mitsuyama | 206/425 |
| 5,080,223 | A * | 1/1992 | Mitsuyama | 206/38 |
| 7,100,766 | B2 * | 9/2006 | Wa Fai | 383/39 |
| 2006/0260957 | A1 * | 11/2006 | Hamilton | 206/5.1 |
| 2009/0101530 | A1 * | 4/2009 | Elliott | 206/316.2 |

* cited by examiner

*Primary Examiner* — Bryon Gehman

(74) *Attorney, Agent, or Firm* — Kauth, Pomeroy, Peck & Bailey LLP

(57) ABSTRACT

The present invention relates generally to job bags for use in the processing, handling, storage and/or transportation of lenses. In several embodiments, the job bags are used in combination with lens bags to transport lenses between various stations in a facility, where processes are applied to the lenses. One embodiment of the invention includes a front panel secured to a back panel, where the front and back panels are joined at least along a bottom edge and form a pocket configured to receive a document, and two vertical pockets formed on the front panel, where each vertical pocket is configured to receive a lens and to retain the lens in the vertical pocket when the job bag rests on its bottom edge.

17 Claims, 4 Drawing Sheets

FIG. 2
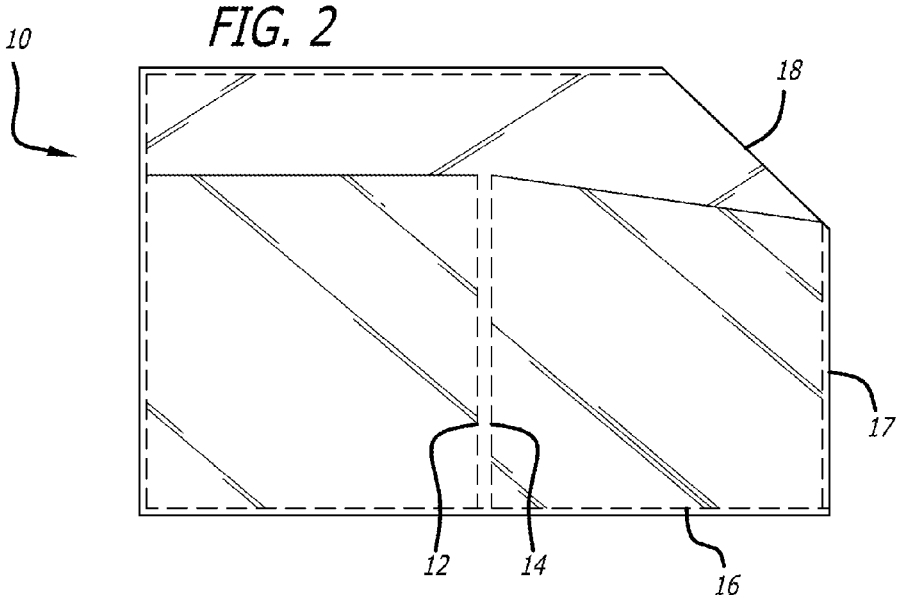
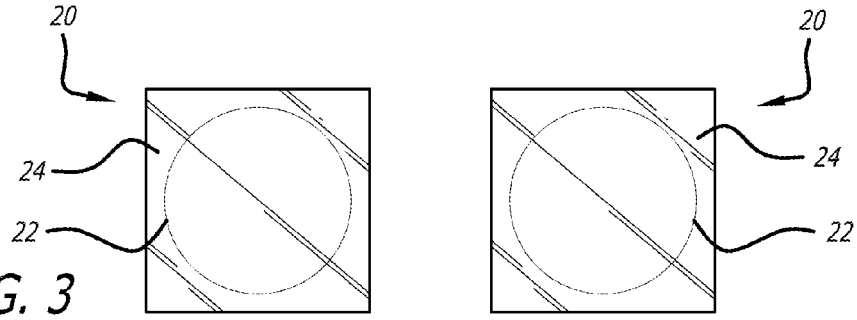
FIG. 3
FIG. 4
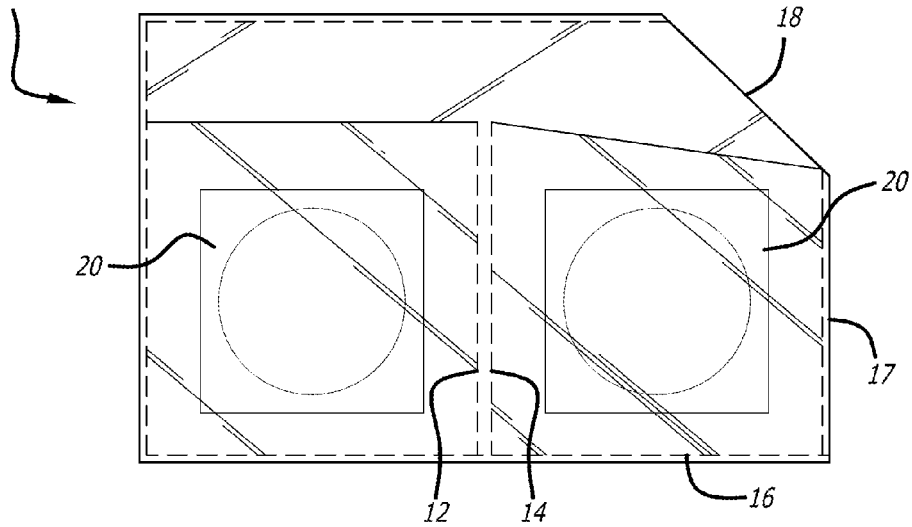

JOB BAG FOR LENSES AND ASSOCIATED DOCUMENT

The present application claims priority to U.S. Provisional Application No. 61/173,143 filed Apr. 27, 2009, the disclosure of which is incorporated herein by reference in its entirety.

FIELD OF THE INVENTION

The present invention relates generally to processes for handling lenses and more specifically to job bags for use during handling of lenses.

BACKGROUND

Lens processing and manufacturing typically involves movement of a pair of lenses from one station to another. Each pair of lenses typically has accompanying documentation. In many instances, the lenses and accompanying documentation are placed in a tray for transport between the various stages in the lens processing and manufacturing. Examples of trays used in lens processing and manufacturing are shown in FIGS. 1*a*-1*c*. The tray 1 shown in FIG. 1*a* includes two lens holders 2 and a compartment 3 for the accompanying documentation. A tray that does not include lens holders is shown in FIG. 1*b*. A baking tray on which multiple pairs of lenses are typically placed is shown in FIG. 1*c*.

When lenses are not held within lens holders, they are free to slide as the tray is transported and can often scratch each other. When a lens is scratched, the lens is typically discarded and a replacement lens is ground resulting in a delay in delivery and an increase in cost. When a single tray is used for each pair of lenses, then the number of pairs of lenses that can be transported by an operator can depend upon the height of a stack of trays that can be carried by the operator and the space available at the operator's station. In addition, the number of pairs of lenses that can be processed by a facility is limited by the number of trays available at the facility. Therefore, a significant number of trays must be kept on hand occupying storage space in order to cope with increases in demand.

SUMMARY OF THE INVENTION

Use of job bags in accordance with embodiments of the invention during the processing, handling, storing, and/or transportation of lenses can significantly decrease the number of lenses that are lost or scratched and must be discarded during manufacture. In addition, the job bags are typically cheaper than trays, occupy less space and are easier to handle in large numbers. In many embodiments, the job bags include a lateral pocket configured to contain documentation, and two vertical pockets configured to contain lenses. In a number of embodiments, lenses are placed within lens bags prior to placement in the vertical lens pockets. In several embodiments, each lens is inserted within a lens bag. In many embodiments, documents inserted into the lateral pocket bear a bar code in an upper corner and the lateral pocket includes an opening with a perimeter that exposes the bar code when the document is inserted in the lateral pocket. One embodiment of the invention includes a front panel secured to a back panel, where the front and back panels are joined at least along a bottom edge and form a pocket configured to receive a document, and two vertical pockets formed on the front panel, where each vertical pocket is configured to receive a lens and to retain the lens in the vertical pocket when the job bag rests on its bottom edge.

In a further embodiment, the front and back panels include at least a bottom edge, a top edge, a first side edge, and a second side edge, and the front and back panels are joined along at least their bottom edges and one of their side edges to form a lateral pocket configured to receive a document inserted between at least the other side edges of the front and back panels.

In another embodiment, the document includes a bar code on a portion of a document, and the front and back panels are configured to form the lateral pocket so that the portion of the document including the bar code extends from the job bag when the document is contained within the lateral pocket.

In a still further embodiment, the side edges of the front and back panels of the job bag are formed so that the opening of the lateral pocket is shaped to expose the portion of said document including the barcode when the document is contained within the lateral pocket.

In still another embodiment, the two vertical pockets are configured to receive lenses contained in lens bags.

In a yet further embodiment, the opening of each of the two vertical pockets is at least 4.5 inches wide.

Yet another embodiment includes a job bag having a front panel secured to a back panel, where the front and back panel are joined at least along a bottom edge and form a pocket configured to receive a document, and two vertical pockets formed on the front panel, where each vertical pocket is configured to receive a lens and to retain the lens in the vertical pocket when the job bag rests on its bottom edge, a document inserted into the pocket formed by the front and back panels of the job bag, and a lens inserted in each of the vertical pockets.

In a further embodiment again, the front and back panels include at least a bottom edge, a top edge, a first side edge, and a second side edge, and the front and back panels are joined along at least their bottom edges and one of their side edges to form a lateral pocket configured to receive a document inserted between at least the other side edges of the front and back panels.

In another embodiment again, the document includes a bar code on a portion of the document, and the portion of the document including the bar code extends from the job bag.

In a further additional embodiment, the side edges of the front and back panels of the job bag are formed so that the opening of the pocket configured to contain the document is shaped to expose the portion of the document including the barcode.

In another additional embodiment, each lens inserted in each of the vertical pockets is contained within a lens bag.

In a still yet further embodiment, each lens bag is a grease free bag.

In still yet another embodiment, the opening of each of the two vertical pockets is at least 4.5 inches wide.

An embodiment of the method of the invention includes, inserting each lens into a separate vertical pocket of a job bag, where the job bag includes at least two vertical pockets, and transporting the job bag.

A further embodiment of the method of the invention includes inserting a document associated with the lenses in a separate pocket in the job bag.

In another embodiment of the method of the invention, the document includes a barcode on a portion of the document and the portion of the document that includes the barcode extends from the job bag when the document is inserted in the job bag.

In a still further embodiment of the method of the invention, the job bag is formed so that the opening of the pocket containing the document is shaped to expose the portion of the document including the barcode.

Still another embodiment of the method of the invention also includes reading the bar code at a point during the transportation of the job bag.

A yet further embodiment of the method of the invention also includes inserting each lens in a separate lens bag prior to inserting the lenses into the vertical pockets of the job bag.

In yet another embodiment of the method of the invention, each lens bag is a grease free bag.

In a further additional embodiment of the method of the invention, the opening of each of the two vertical pockets in the job bag is at least 4.5 inches wide.

Another additional embodiment of the method of the invention also includes placing the job bag on a tray with a plurality of other job bags, and transporting the plurality of job bags using the tray.

BRIEF DESCRIPTION OF THE FIGURES

FIG. 2 is a view of a job bag in accordance with an embodiment of the invention.

FIG. 3 is a view of a pair of lenses contained within lens bags in accordance with embodiments of the invention.

FIG. 4 is a view of a job bag in which a lens contained within a lens bag has been inserted within each vertical pocket of the job bag in accordance with an embodiment of the invention.

DETAILED DESCRIPTION OF THE INVENTION

Figure 1A:
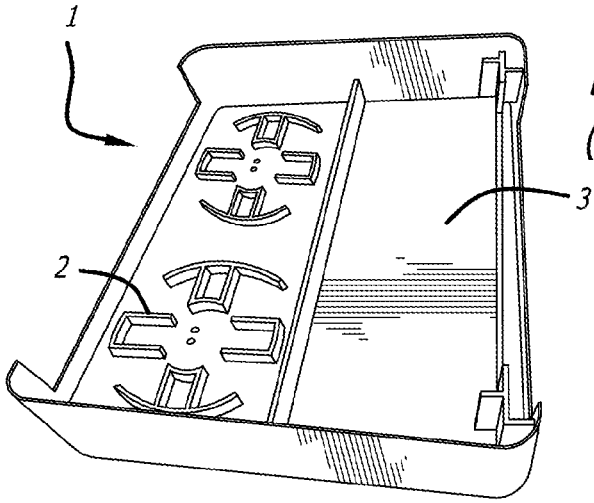
FIG. 1a (Prior Art)
FIGS. 1*a*-1*c* are views of prior art trays for carrying pairs of lenses.
Figure 1B:
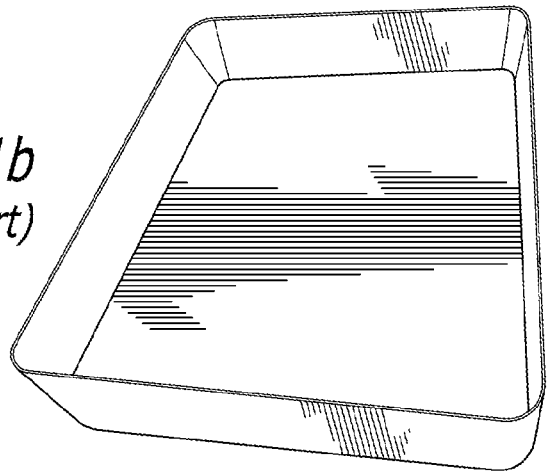
FIG. 1b (Prior Art)
Figure 1C:
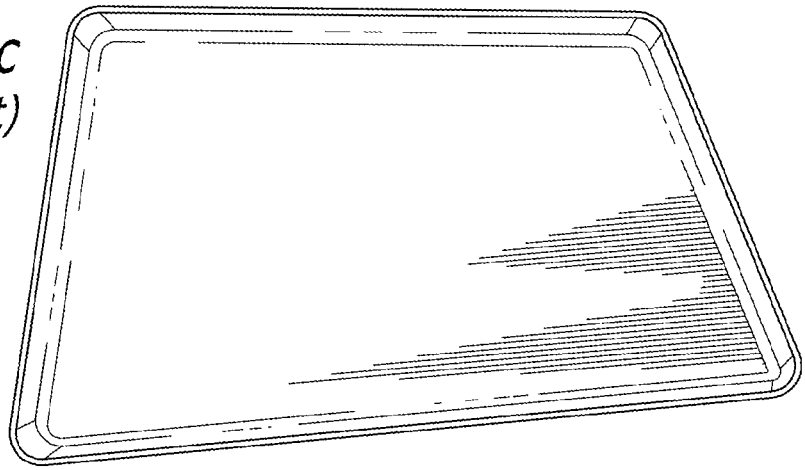
FIG. 1c (Prior Art)

Turning now to the drawings, job bags and processes for handling lenses incorporating job bags in accordance with embodiments of the invention are shown. In a number of embodiments, the job bags incorporate two vertical pockets and a lateral pocket. A lens can be inserted in each vertical pocket and documentation associated with the lenses can be inserted in the lateral pocket. In several embodiments, each lens is inserted within a lens bag. In many embodiments, documents inserted into the lateral pocket bear a bar code and the lateral pocket includes an opening that exposes the bar code of a document inserted in the lateral pocket.

A job bag including vertical lens pockets and a lateral pocket in accordance with an embodiment of the invention is shown in FIG. 2. The job bag 10 includes a left vertical lens pocket 12 and a right vertical lens pocket 14 that are located on a front panel of the job bag. The lens pockets are referred to as vertical lens pockets, because the opening of the lens pockets typically point upward during use to prevent the lenses from falling out of the vertical lens pockets when the job bag rests on its bottom edge. The lens pockets are dimensioned so that at least one lens can be contained within each pocket. When the lenses are for use in prescription glasses, the job bags typically have pockets for each lens having dimensions of at least 4.5"×4.5". In a number of embodiments, the opening of each pocket is at least 4.5" wide. In many embodiments, the dimensions of the pockets are chosen in accordance with the requirements of the application. The job bag also includes a lateral pocket 16 formed by a front and back panel of the job bag. The lateral pocket can be used to contain a paper document, and typically includes an opening on one side of the job bag. In embodiments where the document bears a bar code in an upper corner, the lateral pocket can include an opening with a perimeter that exposes the bar code of a document inserted in the lateral pocket. In the illustrated embodiment, the perimeter of each side of the opening of the lateral pocket includes two non-parallel sections that intersect. The first section 17 is perpendicular to the bottom edge of the job bag. The second section 18 forms an angle with the side of the lateral pocket and the first section 17. Although the opening of the lateral pocket is shown as being on the right hand side of the job bag illustrated in FIG. 2, the opening of the lateral pocket can extend around the right hand side and top of the job bag, be in the top of the job bag, be in the left hand side of the job bag, or extend around the left hand side and top of the job bag or include any other configuration appropriate to a specific application.

Two lens and lens bag combinations in accordance with an embodiment of the invention are illustrated in FIG. 3. Each lens and lens bag combination 20 includes a lens 22 inserted in a lens bag 24. The lens bag is typically constructed from a material that is less abrasive than the material used in the construction of the job bag. In many embodiments, the lens bag is a grease free bag.

A job bag in which lens and lens bag combinations have been inserted in each of the vertical lens pockets in accordance with an embodiment of the invention is shown in FIG. 4. The job bag 10 includes a lens and lens bag combination 20 inserted in each of the left 12 and right 14 vertical pockets. During repeated use, debris can accumulate in the vertical lens pockets. The lens bags that surround the lenses reduce the likelihood that debris within a vertical lens pocket will scratch the surface of the lens. In several embodiments, lenses are placed directly into the vertical pockets and inspections and/or other steps can be performed to identify and/or prevent debris from lodging within the vertical pockets and scratching the lenses.

Figure 5A:
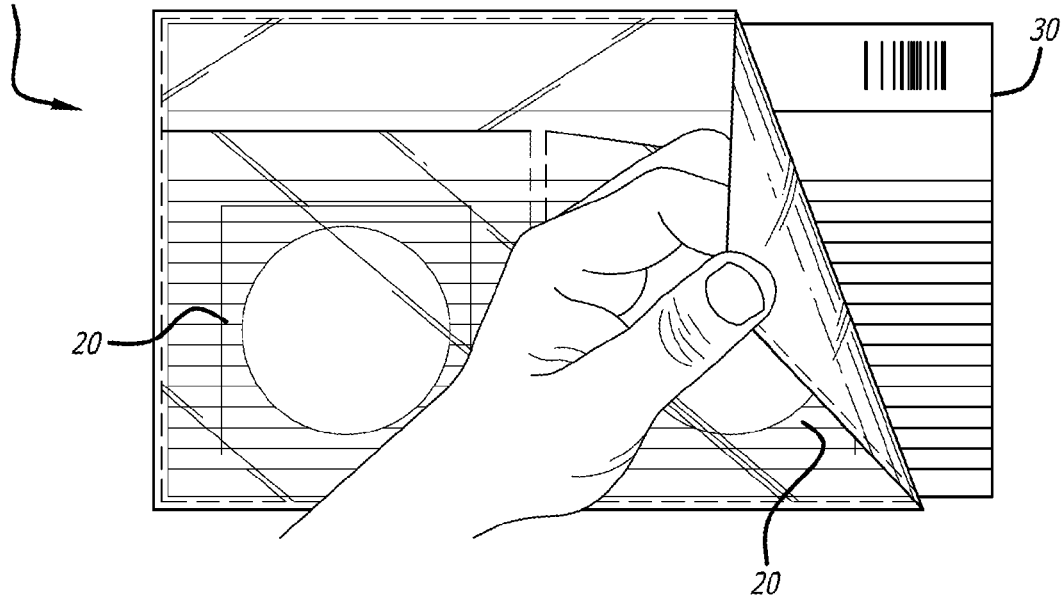
FIGS. 5*a* & 5*b* are views of a job bag in which a lens contained within a lens bag has been inserted within each vertical pocket of the job bag and documentation associated with the lens has been inserted within a lateral pocket of the job bag in accordance with an embodiment of the invention.
Figure 5B:
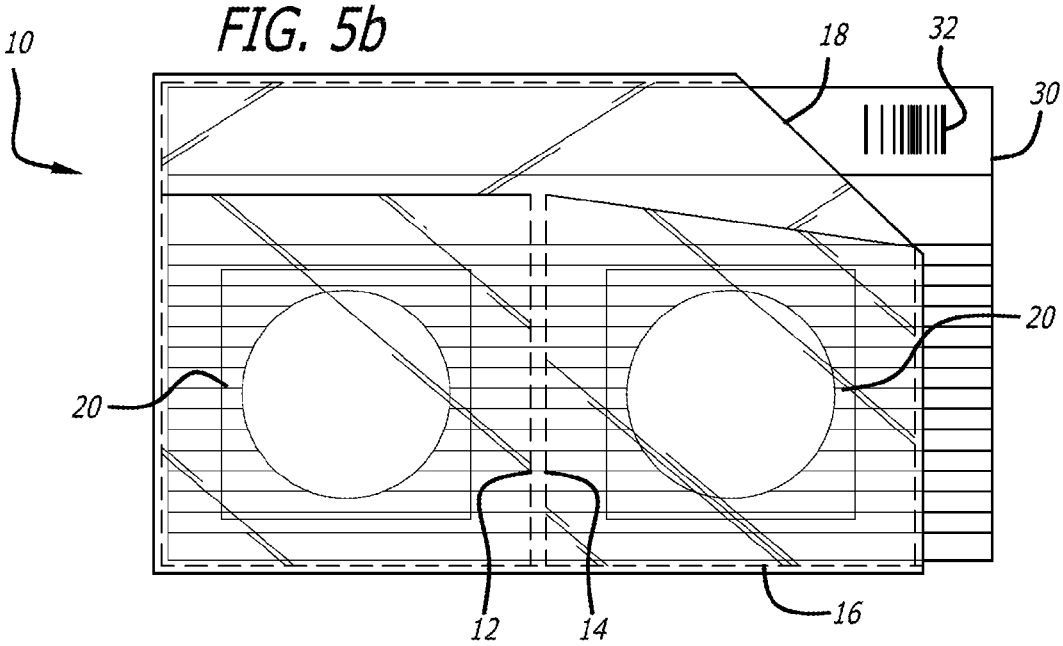

Insertion of a document into a lateral pocket in accordance with an embodiment of the invention is illustrated in FIGS. 5*a* & 5*b*. A document 30 inserted into a lateral pocket of a job bag 10 in accordance with an embodiment of the invention that includes a lens and lens bag combination 20 inserted in one of its vertical lens pockets is shown in FIG. 5*a*. The job bag includes an opening that has a perimeter that exposes a bar code 32 present on the document 30 (see FIG. 5*b*). Exposing the bar code in this way is optional, but can reduce the likelihood of a misread during lens processing. In embodiments having a regular lateral pocket opening (i.e. one that has a perimeter that is perpendicular to the sides of the pocket), the frequency of misreads can increase over the life of the job bag due to curling of the job bag material at the opening of the lateral pocket. The curling of the job bag material can result in multiple layers of material positioned between a bar code scanner and the bar code and reflections can prevent reading of the bar code.

Figure 6:
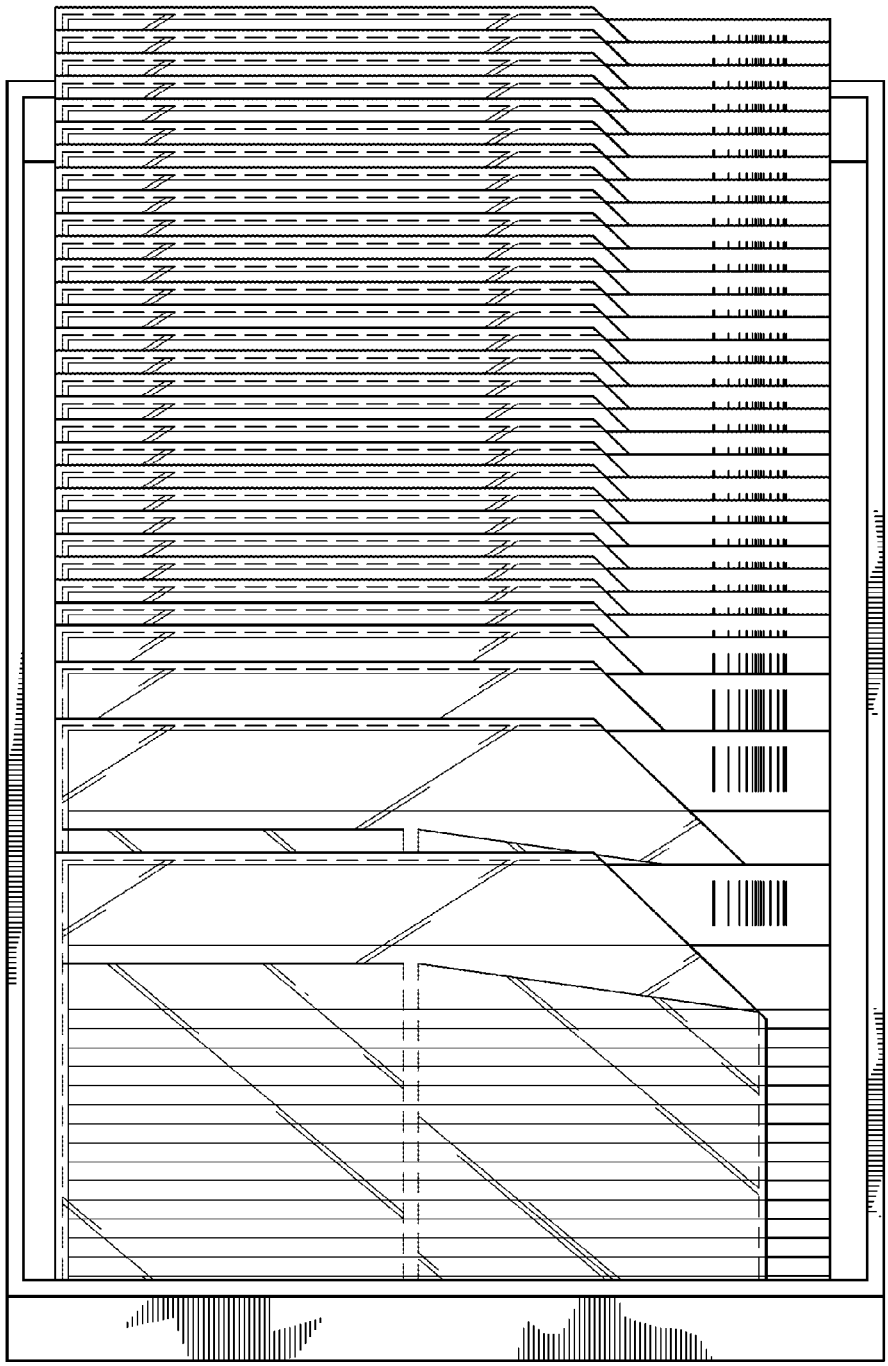
FIG. 6 is a view of a bin containing a number of job bags in accordance with an embodiment of the invention.

The use of job bags can provide a number of benefits compared to the use of a tray including reducing cost, increasing throughput and reducing space requirements. A bin containing multiple job bags in accordance with an embodiment of the invention is illustrated in FIG. 6. As can be seen, an operator can transport a much larger number of job bags than stacked trays. In addition, the cost of construction of each job bag is much lower than that of a tray and the storage requirements of the job bags both in use and when idle are significantly lower. In this way, lenses and accompanying documentation can be transported between various stations in a facility, where processes are applied to the lenses.

While the above description contains many specific embodiments of the invention, these should not be construed as limitations on the scope of the invention, but rather as an example of one embodiment thereof. Although job bags described above include vertical lens pockets and lateral pockets, job bags in accordance with embodiments of the invention can include a vertical pocket to contain documentation, the lens and lens bag combinations can be contained in a single vertical pocket, the openings of the pockets can be oriented differently and/or the openings can be re-sealable, and/or the job bag could be a single pocket in which lens and lens bag combinations and documentation are placed. Furthermore, a single job bag in accordance with an embodiment of the invention can contain pockets for multiple pairs of lenses and their accompanying documentation. Accordingly, the scope of the invention should be determined not by the embodiments illustrated, but by the appended claims and their equivalents.

What is claimed is:

1. A job bag, configured to transport a pair of lenses, and at least one associated document, comprising:

a front panel secured to a back panel, wherein the front and back panels include at least a bottom edge, a top edge, a first side edge, and a second side edge;

two vertical pockets formed on the front panel, where each vertical pocket has an opening configured to receive a lens and to retain the lens in the vertical pocket when the job bag rests on its bottom edge;

wherein the front and back panels are joined along at least their bottom edges and one of their side edges to form a lateral pocket having an opening configured to receive the at least one document inserted between at least the other side edges of the front and back panels; and wherein the at least one document includes a bar code on a portion thereof, and wherein the lateral pocket is dimensioned such that a portion of the at least one document including the bar code extends from the job bag when the at least one document is contained within the lateral pocket.

2. The job bag of claim 1, wherein the side edges of the front and back panels of the job bag are formed so that the opening of the lateral pocket is shaped to expose the portion of the at least one document including the bar code when the at least one document is contained within the lateral pocket.

3. The job bag of claim 1, wherein the two vertical pockets are configured to receive lenses contained in lens bags.

4. The job bag of claim 1, wherein the opening of each of the two vertical pockets is at least 4.5 inches wide.

5. A job bag assembly, comprising:

a job bag including:

a front panel secured to a back panel, where the front and back panels are joined at least along a bottom edge and form a pocket; and two vertical pockets formed on the front panel, where each vertical pocket has an opening configured to receive a lens and to retain the lens in the vertical pocket when the job bag rests on its bottom edge;

a document inserted into the pocket formed by the front and back panels of the job bag; and a lens inserted in each of the vertical pockets.

6. The job bag assembly of claim 5, wherein:

the front and back panels include at least a bottom edge, a top edge, a first side edge, and a second side edge; and the front and back panels are joined along at least their bottom edges and one of their side edges to form a lateral pocket having an opening configured to receive the document inserted between at least the other side edges of the front and back panels.

7. The job bag assembly of claim 6, wherein:

the document includes a bar code on a portion of the document; and wherein the lateral pocket is dimensioned such that the portion of the document including the bar code extends from the job bag.

8. The job bag assembly of claim 7, wherein the side edges of the front and back panels of the job bag are formed so that the opening of the pocket configured to contain the document is shaped to expose the portion of the document including the bar code.

9. The job bag assembly of claim 5, wherein each lens inserted in each of the vertical pockets is contained within a lens bag.

10. The job bag assembly of claim 9, wherein each lens bag is a grease free bag.

11. The job bag assembly of claim 5, wherein the opening of each of the two vertical pockets is at least 4.5 inches wide.

12. A method of transporting a pair of lenses, comprising:

inserting each lens into a separate vertical pocket of a job bag, where the job bag includes at least two vertical pockets each having at least one opening;

inserting a document associated with the lenses in at least one separate lateral pocket, said lateral pocket having an opening in the job bag, wherein the document includes a bar code on a portion of the document and the lateral pocket is dimensioned such that the portion of the document that includes the bar code extends from the job bag when the document is inserted in the lateral pocket of the job bag; and transporting the job bag.

13. The method of claim 12, wherein the job bag is formed so that the opening of the lateral pocket containing the document is shaped to expose the portion of the document including the bar code.

14. The method of claim 12, further comprising reading the bar code at a point during the transportation of the job bag.

15. The method of claim 12, wherein the opening of each of the two vertical pockets in the job bag is at least 4.5 inches wide.

16. A method of transporting a pair of lenses, comprising:

inserting each lens into a separate vertical pocket of a job bag, where the job bag includes at least two vertical pockets each having at least one opening;

inserting each lens in a separate lens bag prior to inserting the lenses into the vertical pockets of the job bag; and transporting the job bag.

17. The method of claim 16, wherein each lens bag is a grease free bag.

* * * * *